US007886563B2

(12) United States Patent
Komori et al.

(10) Patent No.: US 7,886,563 B2
(45) Date of Patent: Feb. 15, 2011

(54) WASHING AND DRYING APPARATUS AND METHOD OF CONTROLLING THE SAME

(75) Inventors: Masanori Komori, Matsubara (JP); Yoshirou Hisai, Osaka (JP); Nobutaka Matsunishi, Fujiidera (JP); Takahisa Ikegami, Nara (JP); Masashi Yamamoto, Habikino (JP)

(73) Assignee: Sharp Kabushiki Kaisha, Osaka (JP)

( * ) Notice: Subject to any disclaimer, the term of this patent is extended or adjusted under 35 U.S.C. 154(b) by 182 days.

(21) Appl. No.: 12/376,850

(22) PCT Filed: Jun. 27, 2007

(86) PCT No.: PCT/JP2007/062845

§ 371 (c)(1),
(2), (4) Date: Feb. 9, 2009

(87) PCT Pub. No.: WO2008/018249

PCT Pub. Date: Feb. 14, 2008

(65) Prior Publication Data

US 2010/0175432 A1 Jul. 15, 2010

(30) Foreign Application Priority Data

Aug. 10, 2006 (JP) ..... 2006-217996

(51) Int. Cl.
*D06F 25/00* (2006.01)

(52) U.S. Cl. ..... 68/18 F; 68/18 C; 68/19.1

(58) Field of Classification Search ..... 68/18 F, 68/18 C, 19.1

See application file for complete search history.

(56) References Cited

U.S. PATENT DOCUMENTS 2,777,313 A * 1/1957 Dodge ..... 68/20
2,910,854 A * 11/1959 Hughes ..... 68/18 R
3,007,334 A * 11/1961 Pall ..... 73/38
3,018,562 A * 1/1962 Orr ..... 34/75

(Continued)

FOREIGN PATENT DOCUMENTS

GB 2 044 297 * 10/1980

(Continued)

OTHER PUBLICATIONS

European Patent Office 0 501 747 Sep. 1992.*

(Continued)

*Primary Examiner*—Frankie L Stinson
(74) *Attorney, Agent, or Firm*—Birch Stewart Kolasch & Birch LLP

(57) ABSTRACT

A washer-dryer apparatus has a blower for sucking air from a water tank and blowing the air into a washing and dewatering tub. At an inlet of the blower is provided a filter, which is cleaned by a cleaning device (300). The cleaning device (300) has a main body (301) pivotable about one end thereof relative to an outer bottom surface of the water tank, a brush (302) provided on the other end of the main body, and a bias spring (303) for biasing the main body toward an opening direction. The main body (301) is subjected to a dynamic pressure of water in the water tank and thereby pivots in an opening direction. When the main body (301) has the pivoting angle of 90°, the brush (302) is in contact with the filter.

7 Claims, 13 Drawing Sheets

U.S. PATENT DOCUMENTS

| | | | | | |
|---|---|---|---|---|---|
| 3,083,557 | A | * | 4/1963 | Decatur | 68/20 |
| 3,111,018 | A | * | 11/1963 | Bonner | 68/20 |
| 4,204,339 | A | * | 5/1980 | Muller | 34/75 |
| 4,532,036 | A | * | 7/1985 | Clifford | 210/167.01 |
| 4,727,733 | A | * | 3/1988 | Huber | 68/12.15 |
| 5,107,606 | A | * | 4/1992 | Tsubaki et al. | 34/596 |
| 5,272,781 | A | * | 12/1993 | Bastin et al. | 8/158 |
| 2003/0089138 | A1 | * | 5/2003 | Kawamura et al. | 68/17 R |
| 2005/0081575 | A1 | * | 4/2005 | Park et al. | 68/18 C |

FOREIGN PATENT DOCUMENTS

| | | | | |
|---|---|---|---|---|
| JP | 60-234699 | | * | 11/1985 |
| JP | 03-026292 | A | | 2/1991 |
| JP | 07-236796 | | * | 9/1995 |
| JP | 2005-143790 | A | | 6/2005 |
| SU | 1011181 | | * | 4/1983 |

OTHER PUBLICATIONS

WIPO WO 01/96647 Dec. 2001.*

* cited by examiner

WASHING AND DRYING APPARATUS AND METHOD OF CONTROLLING THE SAME

BACKGROUND OF THE INVENTION

The present invention relates to a washer-dryer apparatus such as drum-type washer-dryer apparatus and fully automatic washer apparatus and a control method therefor.

FIGS. 14 and 15 show schematic cross-sections of a conventional drum-type washer-dryer apparatus.

As shown in FIG. 14, the drum-type washer-dryer apparatus includes an outer casing 1, a water tank 4 placed in the outer casing 1, a rotation drum 5 placed within the water tank 4 and adapted to accommodate a wash, i.e., things to be washed and things washed, a transparent rigid or inflexible outside door 3, an automatic door opening/shutting mechanism 10 for automatically opening and shutting the outside door 3, and a dryer unit 24 for drying the wash.

An outer casing opening 1*a* is formed on a front face of the outer casing 1 is. A wash is put in and taken out through the outer casing opening 1*a*. The outer casing opening 1*a* is opened and shut by the outside door 3 that is slidable upward and downward with respect to the outer casing 1. As means for opening and shutting the outer casing opening 1*a*, there is also known a door mounted pivotably on a rim of the opening 1*a* by a hinge mechanism or the like, other than the outside door 3.

An operation panel 11 having operation keys, display units and the like is provided on an upper part of the front face of the outer casing 1. A control section 2 for controlling operation of the drum-type washer apparatus is provided on a reverse side (on the water tank 4-side) of the operation panel 11, and thus inputs into the operation panel 11 allow successive or separate performance of washing step, rinsing step, dewatering step, and drying step.

The water tank 4 is elastically supported through medium of a suspension 8. The water tank 4 has a shape of a bottomed cylinder with a water tank opening 4*a* that opens in face of the outer casing opening 1*a*. The water tank 4 is positioned transversely and slantly so that the rear side thereof (the right-hand side in the drawing) is in lower position. The water tank opening 4*a* and the outer casing opening 1*a* face each other with a space between them.

A transparent lid member 6 is mounted to the water tank 4 through a hinge mechanism, so that the water tank opening 4*a* can be opened and shut by the lid member. The lid member 6 is provided with a convex part 6*a* that protrudes toward inside of the rotation drum 5 when the water tank opening 4*a* is shut. A sealing member 41 is provided on an inner circumferential surface of the water tank opening 4*a* and, while the water tank opening 4*a* is shut by the lid member 6, the water tank opening 4*a* is held watertight by intimate contact between the sealing member 41 and the convex part 6*a*.

The rotation drum 5 has a shape of a bottomed cylinder with a drum opening 5*c* that opens in face of the water tank opening 4*a*. The rotation drum 5 is positioned transversely and slantly so that the rear side thereof (right side in the drawing) is in lower position. That is, a rotation axis y-y of the rotation drum 5 is slanted so that the rear side thereof is lowered at an angle θ relative to a horizontal direction. A motor 9 is connected to a backside of the rotation drum 5 through a shaft 5*e*, and is driven to rotate the rotation drum 5 in accordance with control by the control section 2. A plurality of small bores 5*a* are provided throughout a circumferential wall of the rotation drum 5. The small bores 5*a* allow circulation of laundry water (water such as tap water and bath water or water containing detergent or the like), air or the like between a space between the water tank 4 and the rotation drum 5 and a space in the rotation drum 5.

An inner wall surface of the rotation drum 5 is provided with baffles 5*b* protruding radially inwards. The baffles 5*b* are provided circumferentially at three sites at intervals of 120°, for example, and repeatedly lift up and drop the wash with rotation of the rotation drum 5. While the rotation drum 5 is rotating, a fluid balancer 5*d* that surrounds the drum opening 5*c* from outside reduces unbalance caused by one-sided wash and laundry water, through agency of motions of sealed-in fluid in the fluid balancer 5*d*.

The dryer unit 24, which has a blower 31 and a heater device 32, is provided on top of the water tank 4. In the dryer unit 24, the blower 31 is positioned on the rear side of the drum-type washer-dryer apparatus and the heater device 32 is positioned on the front side thereof. The blower 31 includes blower blades 34 in a casing 33 and a fan motor 35 for driving the blower blades 34 to rotate, which motor is provided outside the casing 33. The fan motor 35 is directly connected to the blower blades 34 so as to drive the blower blades 34 to rotate with use of a direct drive structure. On the other hand, the heater device 32 includes a heater 36 in a heater case 26, and an inlet part of the heater case 26 communicates with an outlet part of the casing 33 of the blower 31.

A drain valve 20 is provided below the water tank 4. The drain valve 20 is opened/shut by a drain valve motor not shown. Upon opening of the drain valve 20, water in the water tank 4 is drained through a flexible drain hose 19 to outside.

In the outer casing 1, a blower duct 38 is placed on the front side of the water tank 4. One end of the blower duct 38 communicates with an outlet part of the heater case 26 of the heater device 32, and the other end of the blower duct 38 forms a jet 38*a*. From the jet 38*a*, air heated in the heater 36 is jetted toward inside of the rotation drum 5.koko In the outer casing 1, a dehumidifier 27 is placed on the back side of the water tank 4. With water poured into the dehumidifier 27 through an upper part thereof, the dehumidifier 27 performs dehumidification by cooling and condensing water content of air that passes therethrough. The dehumidifier 27, which is generally hollow, has a water inlet 27*a* and an air outlet 27*b* in the upper part thereof and has an air inlet 27*c* doubling as a water outlet in lower part. The air outlet 27*b* of the dehumidifier 27 communicates with inlet part of the casing 33 of the blower 31, and the air inlet 27*c* communicates with lower part of inside of the water tank 4. To the water inlet 27*a* is connected a feed water supply system not shown.

In the drum-type washer-dryer apparatus having the above configuration, a user opens the lid member 6 directly and manually, thereafter puts a wash into the rotation drum 5 through the outer casing opening 1*a*, and then shuts the lid member 6 directly and manually. Thus inner rim 41*a* of the sealing member 41 is brought into intimate contact with rim of the lid member 6 so that the water tank 4 is sealed. When the user manipulates the operation panel 11 so as to start a washing operation based on instruction from the control section 2, the automatic door opening/shutting mechanism 10 initially slides the outside door 3 in an upward direction in the drawing along a front panel 7. Then the outside door 3 shuts the outer casing opening 1*a*, as shown in FIG. 15, while making a track generally shaped like an arc. Upon termination of the washing operation, subsequently, the automatic door opening/shutting mechanism 10 slides the outside door 3 in a downward direction in the drawing along the front panel 7. Thus the outer casing opening 1*a* is opened again as shown in FIG. 14. After that, the user opens the lid member 6 directly and manually and subsequently takes the wash out of the rotation drum 5.

In a drying operation, the fan motor 35 drives the blower blades 34 to rotate, and the heater 36 is energized. Thus air jetted from the blower 31 is heated to a high temperature by the heater 36 while passing through the heater case 26, then passes through the blower duct 38, the jet 38*a*, and the drum opening 5*c*, and collides with and dries the wash in the rotation drum 5. The hot humid air having absorbed moisture from the wash in the rotation drum flows through the small bores 5*a* provided on the circumferential wall of the rotation drum 5, into the space between the rotation drum 5 and the water tank 4. The space communicates with a space in the dehumidifier 27. Therefore the hot humid air enters the dehumidifier 27, then forms dew by being cooled by cold water flowing through the dehumidifier 27, and thereby undergoes dehumidification. The air dehumidified by the dehumidifier 27 is forwarded afresh by the blower 31 to the heater 36, heated in the heater 36, and then delivered into the rotation drum 5. In this manner, a process of drying the wash in the rotation drum 5 is carried out.

In the conventional drum-type washer-dryer apparatus, however, foreign matter such as flue produced from a wash and circulated with air in the drying step is not eliminated. Accordingly, such foreign matter may adhere to a shaft (not shown) linking the blower blades 34 to the fan motor 35 and may thus form a resistance against rotation of the blower blades 34 and the shaft.

As a result, degradation in blowing capacity of the blower 31 may lead to degradation in drying capacity such as elongation in time required for drying.

As a method for preventing the foreign matter from entering the blower blades 34, a method is conceivable in which a filter for trapping the foreign matter is provided on the upstream side of the inlet part of the casing 33 of the blower 31.

Even though the filter is provided, however, repetition of the drying steps may lead to clogging of the filter with the foreign matter and may result in degradation in suction capacity of the blower 31.

Consequently, a user has to clean the filter each time the filter is clogged and there occurs a problem of increase in burden on user.

SUMMARY OF THE INVENTION

It is an object of the invention to provide a washer-dryer apparatus that is capable of preventing degradation in drying capacity and reducing burden on user, and to provide a control method therefor.

In order to accomplish the above object, a washer-dryer apparatus according to the present invention comprises:

an outer casing, a water tank provided in the outer casing, a water feeding channel for feeding water into the water tank, a washing and dewatering tub that is rotatably placed in the water tank and that accommodates a wash, a blower that has an inlet for sucking air from the water tank and that blows into the washing and dewatering tub the air sucked through the inlet, a filter that is positioned so as to face the washing and dewatering tub and that covers the inlet, a heater unit for heating air that is sucked from the inlet and that flows toward inside of the washing and dewatering tub, and a cleaning device that is mounted on a mount surface comprising a part of a water tank-side surface of the washing and dewatering tub and that makes a track across the filter when the washing and dewatering tub rotates, the cleaning device, comprising:

a cleaning part, a main body that is provided with the cleaning part and positioned such that at least part thereof is soaked in water supplied into the water tank, wherein the main body brings the cleaning part into contact with the filter by pivoting in an opening direction relative to the mount surface until a pivoting angle of the main body becomes a first angle, while the main body breaks the contact between the cleaning part and the filter by pivoting in a closing direction and bringing the cleaning part closer to the mount surface, and a bias part for biasing the main body toward the closing direction.

In the washer-dryer apparatus having the above configuration, the blower sucks air through the inlet from inside of the water tank and blows the sucked air into the washing and dewatering tub. The inlet is covered with the filter, so that foreign matter in air flowing toward the blower is eliminated by the filter.

This prevents the degradation in blowing capacity of the blower that may be caused by such foreign matter and thus prevents the degradation in drying capacity of the washer-dryer apparatus.

After water is fed into the water tank, at least part of the main bodies of the cleaning devices are soaked in the water by the rotation of the washing and dewatering tub. Subsequently, the washing and dewatering tub is rotated in a predetermined direction and a dynamic pressure of the water is thereby applied to each of the main bodies. If a rotation speed of the washing and dewatering tub then takes on a predetermined value, the main body pivots in an opening direction against a biasing force of the bias spring and the pivoting angle of the main body reaches the first angle.

By resultant contact of the cleaning parts of the cleaning devices with the filter, the filter is cleaned by the cleaning parts and clogging of the filter is prevented.

Thus a burden on user with regard to maintenance of the filter can be reduced.

The first angle is preferably larger than 0°.

In one embodiment, the cleaning device includes a first stopper for preventing the pivoting angle of the main body from exceeding the first angle.

In the washer-dryer apparatus of the embodiment, the first stopper prevents the pivoting angle of the main body from exceeding the first angle and thus prevents excessive opening of the main body, so that the cleaning parts can reliably be brought into contact with the filter.

In one embodiment, the cleaning device comprises a second stopper for preventing the pivoting angle of the main body from being less than a second angle that is less than the first angle.

In the washer-dryer apparatus of the embodiment, the second stopper prevents the pivoting angle of the main body from being less than the second angle that is less than the first angle and therefore provides a gap between the main body and the mount surface.

Accordingly, the main body can easily be pivoted in the opening direction without increase in rotation speed of the washing and dewatering tub.

The second angle is preferably larger than 0°.

In one embodiment, the washing and dewatering tub has a cylindrical shape and the mount surface is a bottom surface on the water tank side of the washing and dewatering tub.

In the washer-dryer apparatus of the embodiment, the mount surface is the bottom surface on the water tank side of the washing and dewatering tub and thus part of the mount surface can be soaked in water even with decrease in quantity of water that is fed into the water tank.

Accordingly, the cleaning devices can be soaked in water and the filter can be cleaned by the cleaning devices even if the quantity of water in the water tank is small. Thus an effect of saving water is achieved.

In addition, the mount surface is the bottom surface on the water tank side of the washing and dewatering tub and thus the cleaning devices can easily be mounted onto the mount surface.

In one embodiment, a pivot of the main body of the cleaning device is slanted relative to a radial direction of the washing and dewatering tub.

In the washer-dryer apparatus of the embodiment, the pivot of the main body is slanted relative to the radial directions of the washing and dewatering tub, and thus wind noise caused by the cleaning devices can be reduced.

A washer-dryer apparatus controlling method according to the present invention is intended for controlling the washer-dryer apparatus according to the present invention, the method comprising:

a water feeding step of feeding water into the water tank such that a part of the filter where the track of the cleaning device crosses the filter is soaked in the water, and a rotating step of rotating the washing and dewatering tub, after the water feeding step, at a rotation speed at which the pivoting angle of the main body becomes the first angle.

In the washer-dryer apparatus controlling method having the above configuration, water is fed into the water tank so that the part of the filter overlapping with the tracks of the cleaning devices may be soaked in the water, and the washing and dewatering tub is thereafter rotated at the rotation speed at which the pivoting angle of the main body makes the first angle.

Thus the cleaning parts can reliably be brought into contact with the filter and clogging of the filter can reliably be prevented.

In one embodiment, a direction in which the washing and dewatering tub is rotated in the rotating step is opposed to a direction in which the washing and dewatering tub is rotated in a dewatering step.

In the washer-dryer apparatus controlling method of the embodiment, the direction in which the washing and dewatering tub is rotated in the rotating step is opposed to the direction in which the washing and dewatering tub is rotated in the dewatering step, and the main body is therefore prevented from opening in the dewatering step.

As a result, unnecessary contact of the cleaning parts with the filter is reduced, so that a life span of the cleaning parts can be prolonged.

In the washer-dryer apparatus of the invention, the inlet is covered with the filter, so that foreign matter in air flowing toward the blower is eliminated by the filter. This prevents the degradation in blowing capacity of the blower that may be caused by the foreign matter and thus prevents the degradation in drying capacity of the washer-dryer apparatus.

In the apparatus, water is fed into the water tank, at least part of the main bodies of the cleaning devices are soaked in the water by the rotation of the washing and dewatering tub, the washing and dewatering tub is thereafter rotated at the predetermined rotation speed in the predetermined direction, and the main bodies subjected to the dynamic pressure of the water pivot in the opening direction against the biasing forces of the bias parts, so that the pivoting angle of each of the main bodies thereby reaches the first angle. By the resultant contact of the cleaning parts of the cleaning devices with the filter, the filter is cleaned by the cleaning parts and clogging of the filter can be prevented.

Thus a burden on user with regard to maintenance of the filter can be reduced.

DETAILED DESCRIPTION OF THE INVENTION

Figure 1:
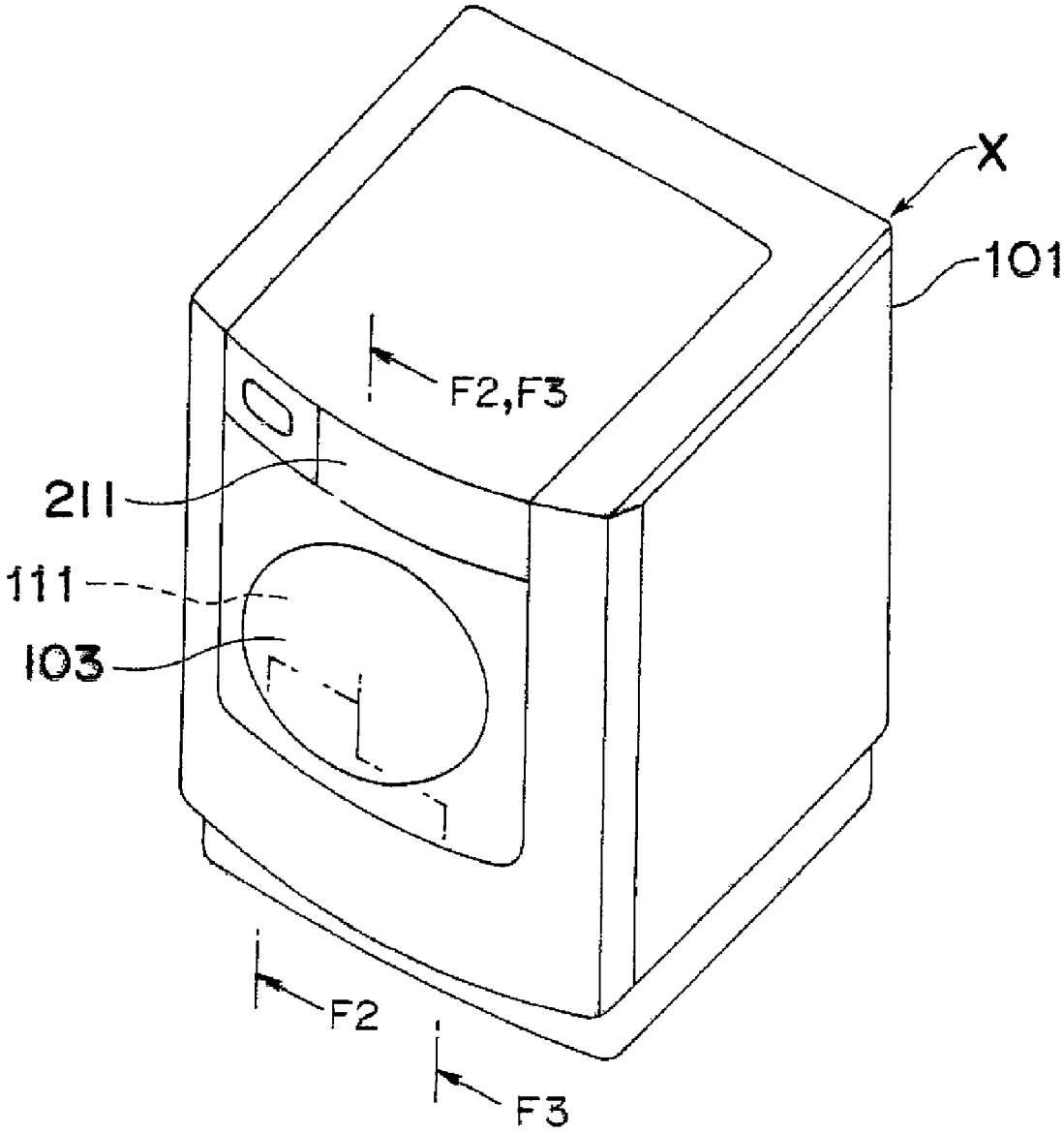
FIG. 1 is a schematic perspective view of a drum-type washer-dryer apparatus in accordance with an embodiment of the invention.

Hereinbelow, a washer-dryer apparatus of the present invention will be described in detail with reference to embodiments shown in the drawings. The embodiments below are an example in which the invention is embodied and are not limitative to the technical scope of the invention.

FIG. 1 shows a diagrammatic view of a drum-type washer-dryer apparatus X in accordance with an embodiment of the invention, as seen looking diagonally from above.

The drum-type washer-dryer apparatus X has an outer casing 101 that covers periphery thereof. On a front face of the outer casing 101 is formed an outer casing opening 111. Reference numeral 211 in FIG. 1 denotes an operation panel.

Figure 2:
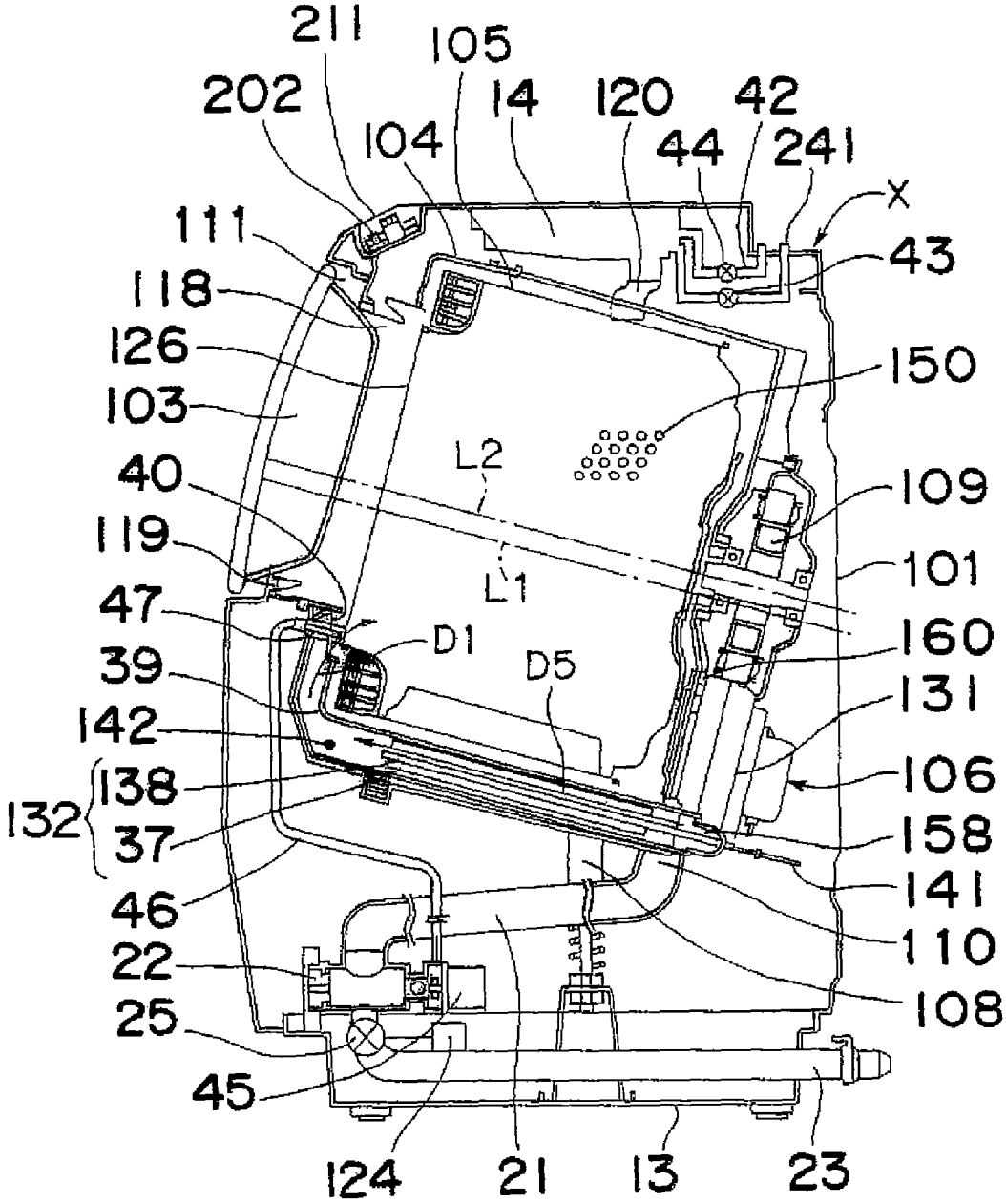
FIG. 2 is a schematic sectional view taken along line F2-F2 in FIG. 1.

FIG. 2 shows a schematic section taken along line F2-F2 in FIG. 1.

A door 103 for opening/shutting the outer casing opening 111 is pivotably mounted on the front face of the outer casing 101 by a hinge mechanism. On upper part of the front face of the outer casing 101 is provided the operation panel 211 having operation keys, display units and the like. A control section 202 for controlling operation of the drum-type washer-dryer apparatus X is provided on reverse side of the operation panel 211 (on a side of a water tank 104). Inputs into the operation panel 211 allow successive or separate performance of washing step, rinsing step, dewatering step, and drying step. In the outer casing 101 is provided a suspension 108 that elastically supports the water tank 104.

In the outer casing 101 is provided the water tank 104 having a shape of a bottomed cylinder. The water tank 104 is slanted so that rear side of a central axis L1 (which will be referred to as "central axis L1 of the water tank 104," hereinbelow) passing through centers of gravity in sections perpendicular to a cylinder axis of the water tank 104 is lowered. On front face part of the water tank 104 is provided a water tank opening 118 that opens in face of the outer casing opening 111.

In the water tank 104 is provided a rotation drum 105 having a shape of a bottomed cylinder, as an example of washing and dewatering tub. On front face part of the rotation drum 105 is provided a drum opening 126 that opens in face of the water tank opening 118. A motor 109 is connected to a backside of the rotation drum 105, and the rotation drum 105 can be rotated in the water tank 104. The rotation drum 105 is slanted so that rear side of a central axis (rotation axis) L2 thereof is lowered. A plurality of small bores 150 (partially shown in FIG. 2) are formed throughout a circumferential wall of the rotation drum 105. The small bores 150 allow circulation of laundry water (water such as tap water and bath water or water containing detergent or the like), air and the like between a space between the water tank 104 and the rotation drum 105 and a space in the rotation drum 105. The central axis L2 of the rotation drum 105 is deviated upward from the central axis L1 of the water tank 104.

In lower part of a space in the water tank 104 is placed a blower duct 39 through which warm air to be supplied into the rotation drum 105 flows. A front end of the blower duct 39 forms a blower port 40 positioned between a lower edge of the water tank opening 118 and a lower edge of the opening 126 of the rotation drum 105. Thus the air flowing through the blower duct 39 in a direction of an arrow D1 goes out of the blower port 40 and flows into the rotation drum 105. A rear end of the blower duct 39 is connected to a discharge opening 158 of a fan case 134 (see FIG. 6) that will be described later.

Inside the blower duct 39 is provided a heater unit 132. The heater unit 132 is composed of a heater case and a sheathed heater 138 of which major portion is housed in the heater case 37. The heater case 37 is composed of a main body made of metal and a frame for fixing the main body which frame is made of heat resistant resin, and a front end thereof is connected to the blower duct 39. The sheathed heater 138 is capable of heating air in the water tank 104 and is also capable of heating laundry water in the water tank 104 because the heater is placed in an area to be soaked in the laundry water in the water tank 104.

To the water tank opening 118 of the water tank 104 is fixed packing 119 composed of elastic body such as rubber and soft resin. Thus shutting the door 103 brings the door 103 into intimate contact with the packing 119, so that liquid in the water tank 104 is prevented from leaking out of the water tank 104.

To top of the water tank 104 is connected a lower end of a feed water duct 120 for feeding laundry water into the water tank 104. On the other hand, upper end part of the feed water duct 120 is connected to lower part of a detergent case 14. To the detergent case 14 are connected a tap water feeding channel 241 and a bath water feeding channel 42. A feed valve 43 is provided in middle of the tap water feeding channel 241, and a bath water pump 44 is provided in middle of the bath water feeding channel 42. The tap water feeding channel 241 or the bath water feeding channel 42 is an example of water feeding channel.

In a lower part of the water tank 104 is provided a drain hole 110 for draining laundry water in the water tank 104 which hole communicates with the blower duct 39. The drain hole 110 is positioned on downstream side of the blower 131. To the drain hole 110 is connected upper end part of a drain duct 21. Lower end part of the drain duct 21 is connected through a filter unit 22 to a drain hose 23. Liquid flowing through the drain duct 21 passes through the filter unit 22 before flowing into the drain hose 23 or into a circulation hose 46. The filter unit 22 eliminates foreign matter as thrum in laundry water that has been flowing through the drain duct 21, and thus prevents the foreign matter from entering the drain hose 23 or the circulation hose 46.

In the drain hose 23 is provided a drain valve 25 that is opened/shut by a drain motor 124. The drain valve 25 is controlled so as to be opened when washing water in the drain duct 21 is made to flow into the drain hose 23 and so as to be shut when washing water in the drain duct 21 is made to flow into the circulation hose 46. An upper end of the circulation hose 46 is connected to a circulation nozzle 47 that is positioned in lower part of the front face of the water tank 4 and that is directed to inside of the rotation drum 5. On the other hand, a lower end of the circulation hose 46 is connected to a circulating pump 45 that is positioned behind the filter unit 22. The circulating pump 45 sucks washing water in the drain duct 21, through the filter unit 22, and discharges the sucked washing water into the circulation hose 46. By activation of such circulating pump 45, washing water drained out of the water tank 4 through the drain hole 110 can be made to pass through the filter unit 22 and can thereafter be returned into the rotation drum 5. In the washing process or the rinsing process, washing water is kept clean by the removal of foreign matter while such circulation of the washing water is carried out.

An upper end of the circulation hose 46 is connected to a circulation nozzle 47. The circulation nozzle 47 is provided in lower part of the front face of the water tank 104 so as to be directed to inside of the rotation drum 105. On the other hand, a lower end of the circulation hose 46 is connected to a circulation pump 45 that is positioned behind the filter unit 22.

The circulation pump 45 sucks laundry water residing in the drain duct 21, through the filter unit 22, and discharges the sucked laundry water into the circulation hose 46. By activation of such circulation pump 45, laundry water drained out of the water tank 104 through the drain hole 110 can be made to pass through the filter unit 22 and can thereafter be returned into the rotation drum 105. In the washing step or the rinsing step, laundry water is kept clean by the removal of foreign matter while such circulation of the laundry water is carried out.

A dryer system 106 is provided on an inlet of the drain hole 110 communicating with the blower duct 39. The dryer system 106 has a blower 131, a heater unit 132, the blower duct 39, and a dehumidifying heat exchanger 133 (see FIG. 3) that will be described later. A filter 160 having metallic yarn woven reticularly is provided in a dehumidification channel 164 (see FIG. 3) between the dehumidifying heat exchanger 133 and the blower 131.

The blower 131, the heater unit 132, the dehumidifying heat exchanger 133, the filter 160, and the blower duct 39 are positioned below a plane including the central axis L1 of the water tank 104 and including a horizontal axis orthogonal to the center line L1. Thus such members as the units of the dryer system 106 and the filter 160 are cleansed by being soaked in laundry water in the washing step or the rinsing step. Reference numeral 13 in FIG. 2 denotes a bottom platform, and numeral 142 denotes a thermistor. The thermistor 142 is capable of detecting a temperature of air flowing in the blower duct 39.

Figure 3:
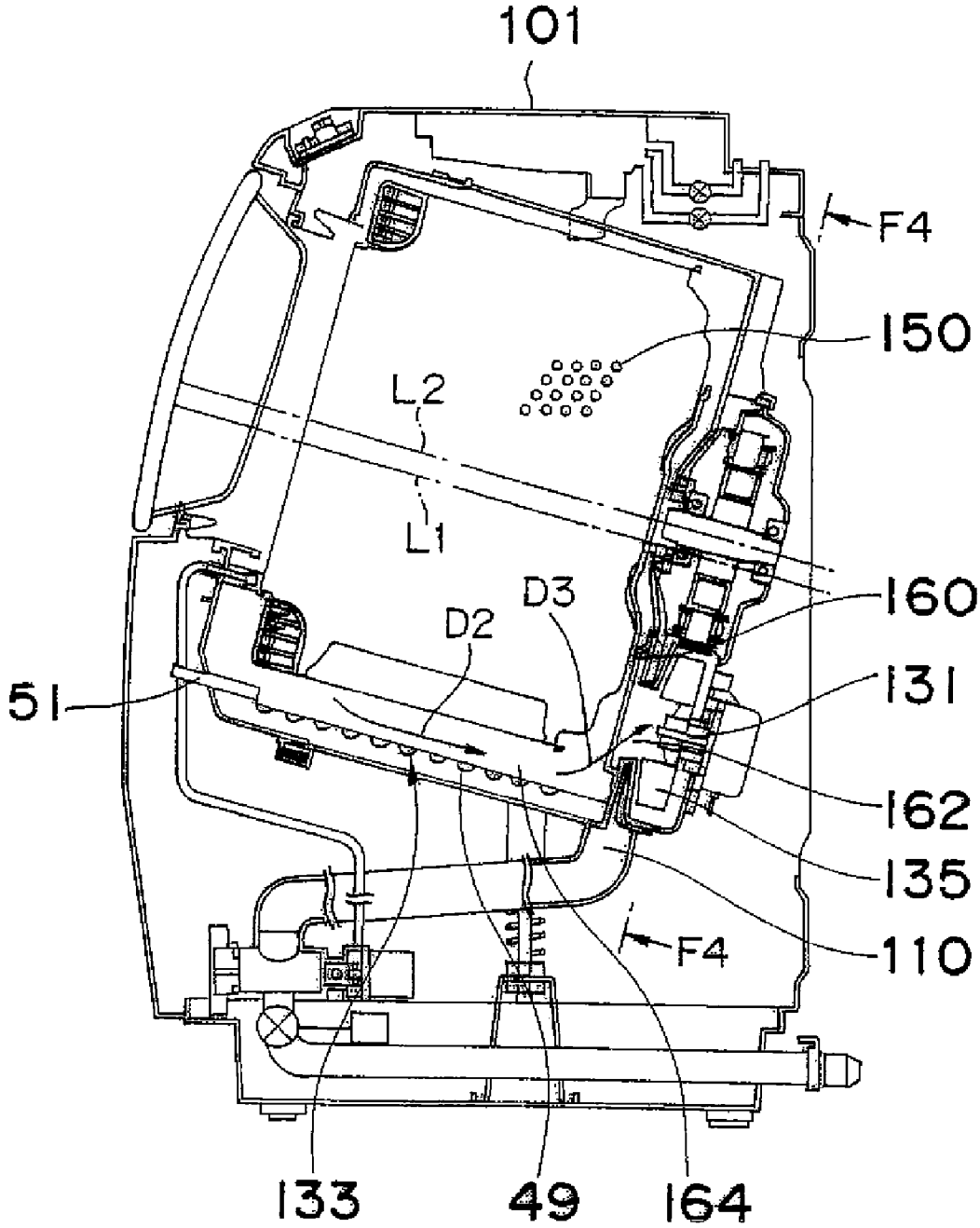
FIG. 3 is a schematic sectional view taken along line F3-F3 in FIG. 1.

FIG. 3 shows a schematic section taken along line F3-F3 in FIG. 1.

The dehumidifying heat exchanger 133 is connected to upstream side of the blower 131 mounted in lower part of a rear face of the water tank 104. More particularly, the dehumidifying heat exchanger 133 is placed in a region that is between an inner circumferential surface of the water tank 104 and an outer circumferential surface of the rotation drum 105 and that is soaked in laundry water in the washing step or the rinsing step.

The dehumidifying heat exchanger 133 has a metal plate 49 that is slantly positioned so that front side thereof is higher than rear side, and fixation members 50 (see FIG. 4 and FIG. 5) that are made of stainless steel and that are installed on both sides of the metal plate 49.

A cooling nozzle 51 is provided over a front end of the metal plate 49. In the drying step, cooling water supplied from the cooling nozzle 51 flows on an upper surface of the metal plate 49 so as to cool the metal plate 49. In this manner, the cooling water and the metal plate cool air flowing in a direction of an arrow D2, and moisture the air contains is thereby condensed effectively.

The blower 131 is mounted in a lower part of the rear face of the water tank 104. Inside of the blower 131 communicates with the space in the water tank 104 via the inlet 162, and air in the water tank 104 is sucked into the blower 131 with rotation of a blower fan 135.

Figure 4:
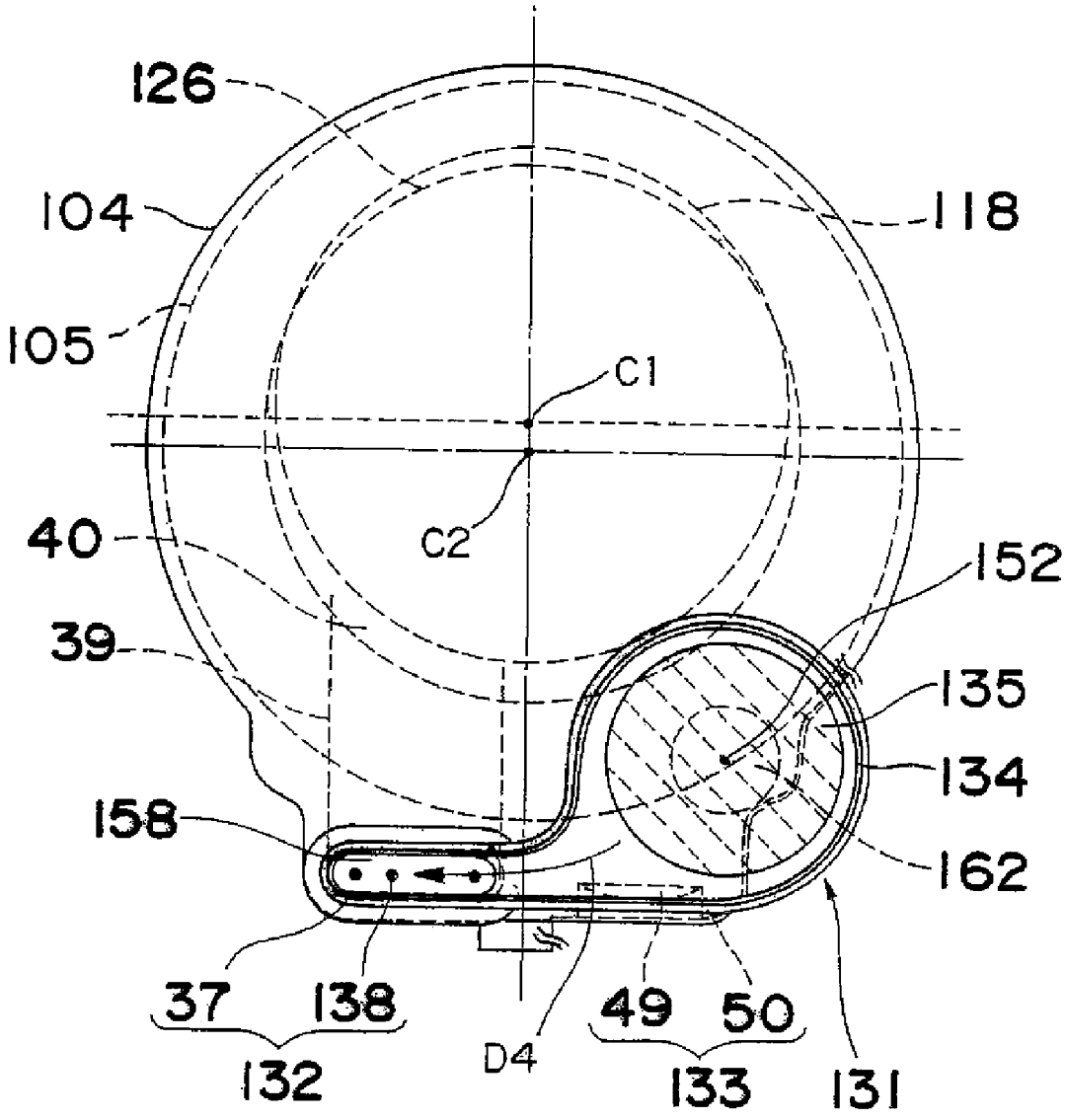
FIG. 4 is a schematic sectional view taken along line F4-F4 in FIG. 3.

FIG. 4 shows a schematic section taken along line F4-F4 in FIG. 3.

The water tank 104 has a downward protrusion, and the blower 131 is positioned so as to coincide with the protrusion. Periphery of the blower 131 is defined by the fan case 134. The blower fan 135 is rotatably placed in the fan case 134. The fan case 134 extends horizontally across the protrusion in lower part of the water tank 104. In the protrusion are placed the heater unit 132 and the dehumidifying heat exchanger 133. A space where the heater unit 132 is placed communicates with a space where the dehumidifying heat exchanger 133 is placed, through the inlet 162 and the discharge opening 158.

A center C1 of the water tank opening 118 is nearer to a top face of the outer casing 101 than a center C2 of the drum opening 126 is. That is, the water tank opening 118 is more eccentric toward the top face of the outer casing 101 than the drum opening 126 is. Reference numeral 152 in FIG. 4 denotes a shaft. One end of the shaft 152 is connected to the blower fan 135.

Figure 5:
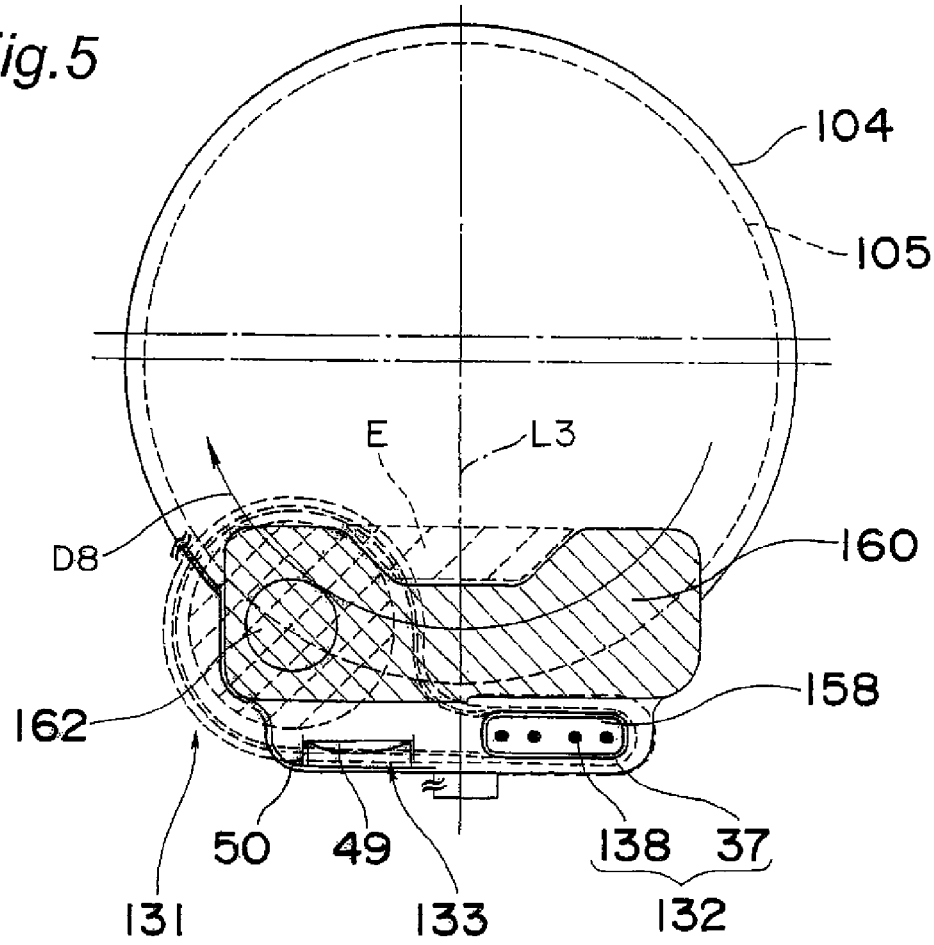
FIG. 5 is a schematic diagram showing an inner bottom surface of a water tank of the drum-type washer-dryer apparatus.

FIG. 5 shows a diagrammatic view of an internal bottom surface of the water tank 104. In FIG. 5, which is a view of the water tank 104 from front side, a portion of the water tank 104 is omitted.

In the protrusion in the lower part of the water tank 104, the heater unit 132 is placed on right side as seen looking from the front side and the dehumidifying heat exchanger 133 is placed on left side as seen looking from the front side. The heater unit 132 and the dehumidifying heat exchanger 133 are positioned so as to be parallel to the central axis L1 of the water tank 104. The dehumidifying heat exchanger 133 is positioned on upstream side, with respect to the circulating air, and the heater unit 132 is positioned on the downstream side. The blower 131 is positioned on downstream side of the dehumidifying heat exchanger 133 and on the upstream side of the heater unit 132.

Figure 8:
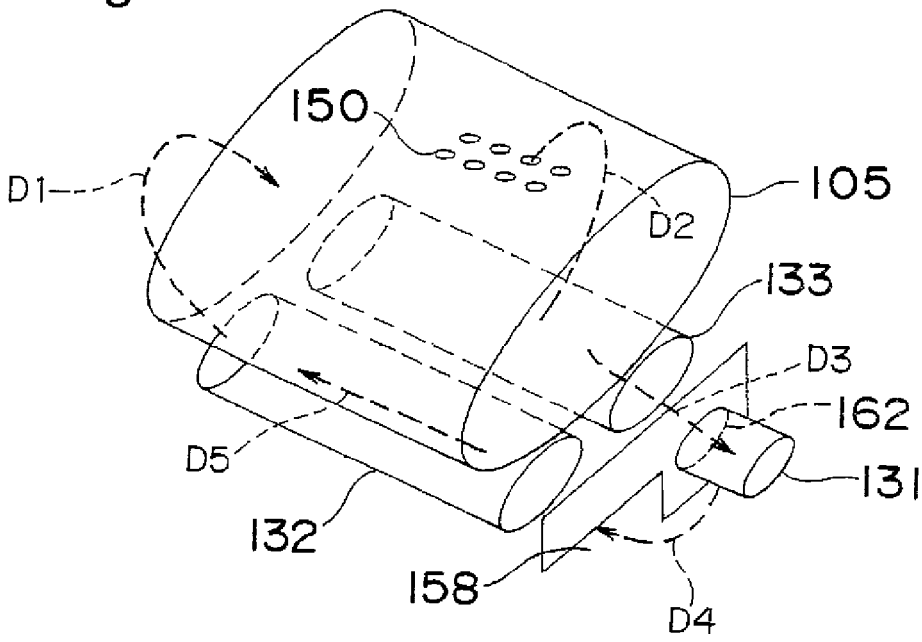
FIG. 8 is a schematic diagram showing air flow in a drying step.

The circulating air occurs in the drying step. More particularly, the blower 131 is activated in the drying step. Thus air is heated while passing through the heater unit 132 as shown by an arrow D5 in FIG. 2 and is thereafter forced to blow from the water tank opening 118 into the rotation drum 105 as shown by the arrow D1 in FIG. 2. The air having vaporized moisture from wet wash in the rotation drum 105 and having got high humidity flows out, through the small bores 150 on the whole circumferential wall of the rotation drum 105, to the space between an inner surface of the water tank 104 and an outer surface of the rotation drum 105 and further flows along the dehumidifying heat exchanger 133 as shown by the arrow D2 in FIG. 3. The air having got high humidity is then cooled and dehumidified by the dehumidifying heat exchanger 133 and the cooling water. The dehumidified air enters through the filter 160 and the inlet 162 into the blower 131 as shown by an arrow D3 in FIG. 3. The dehumidified air flows as shown by an arrow D4 in FIG. 6, subsequently flows from the discharge opening 158 toward the heater unit 132, and is heated again by the heater unit 132. With repetition of such air circulation as described above, the process of drying the wash progresses. FIG. 8 schematically shows the air flow in the drying step.

In the drying step, as described above, a wash is dried with air in the water tank 4 sequentially passed and circulated through the dehumidifying heat exchanger 133, the blower 131, and the heater unit 132. In this step, minute dust such as cotton waste from the wash passes through the filter 160, may enter the fan case 134 and adhere to an inner surface of the fan case 134, one end of the shaft 152 or the blower fan 135; in the next washing step or the next rinsing step, however, the inside of the fan case 134, the one end of the shaft 152 or the blower fan 135 are soaked in laundry water having flowed into the fan case 134, and the minute dust is therefore washed away and removed by the laundry water. This prevents constriction of the air channel in the fan case 134 and an increase in resistance against the rotation of the blower fan 135, and allows constantly efficient circulation of air for drying a wash.

Figure 6:
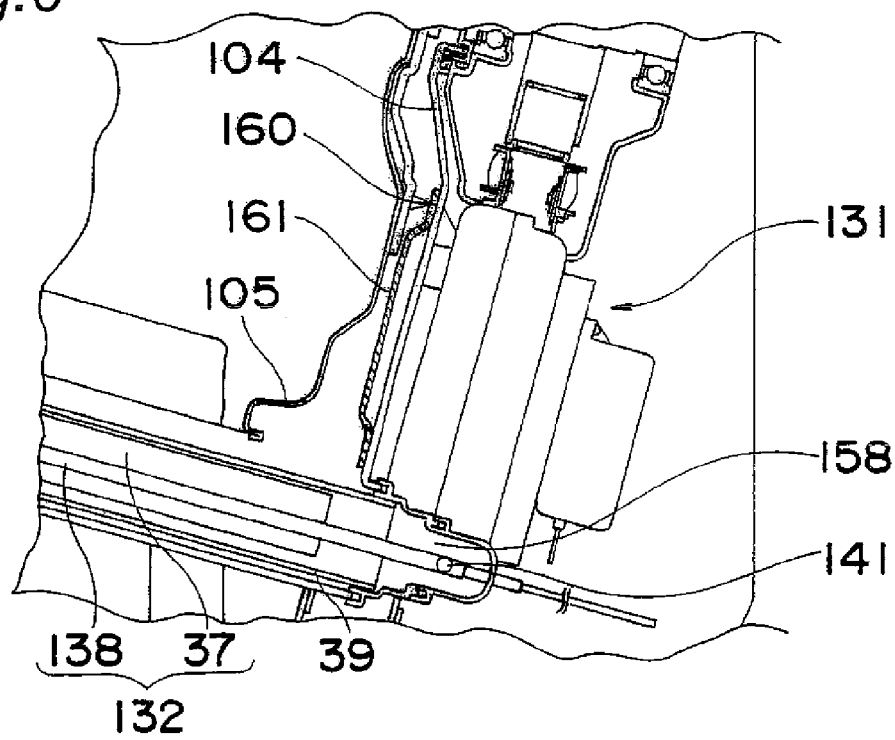
FIG. 6 is a detail of main part of FIG. 2.

FIG. 6 shows detail of surroundings of the filter 160 in FIG. 2.

The blower 131 is connected to the water tank 104 through the discharge opening 158 that is an outlet of blast from the blower 131. The discharge opening 158 is connected to the rear end of the blower duct 39. Reference numeral 141 in FIG. 6 denotes a thermistor. The thermistor 141 is capable of detecting a temperature of air jetted out of the discharge opening 158.

Figure 7:
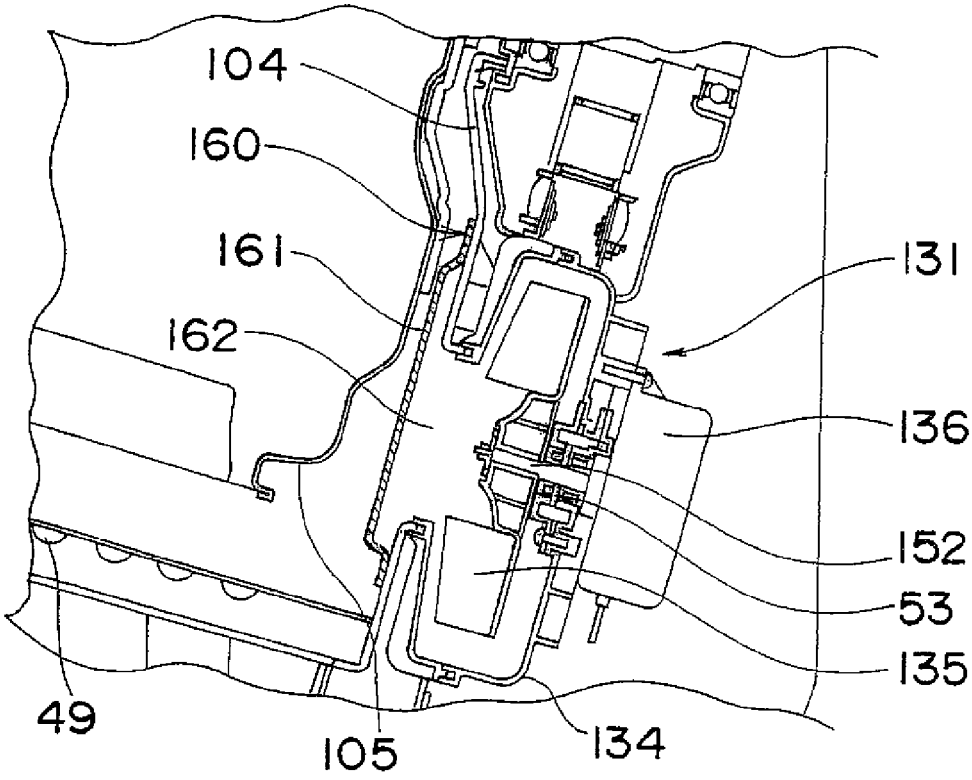
FIG. 7 is a detail of main part of FIG. 3.

FIG. 7 shows detail of surroundings of the filter 160 in FIG. 3.

The blower 131 has the fan case 134, the blower fan 135 that is positioned so as to be rotatable in the fan case 134, a fan motor 136 that drives the blower fan 135 to rotate, the shaft 152 that has one end connected to the blower fan 135 and the other end connected to the fan motor 136, and a seal receiving part 53 that is provided so as to radially surround the shaft 152.

The shaft 152 receives a rotational driving force from the fan motor 136 and thus rotates with the blower fan 135. As described above, the one end of the shaft 152 is positioned so as to be soaked in washing water that flows into the fan case 134 in the washing process or the rinsing process. The blower fan 135, which makes air blow against the wash in the drying process, can be controlled so as to rotate also in the washing process or the rinsing process to produce water flow. The shaft 152 receives a rotational driving force from the fan motor 136 and thus rotates with the blower fan 135. The one end of the shaft 152 is positioned so as to be soaked in laundry water that flows into the fan case 134 in the washing step or the rinsing step. The blower fan 135 produces air blow for drying a wash in the drying step. In the washing step or the rinsing step also, however, the blower fan can be controlled so as to rotate to produce water flow.

The blower 131 is also connected to the water tank 104 through the inlet 162 that is an entrance for air blow the blower 131 produces. The filter 160 having metallic yarn woven reticularly is provided in a space between the inlet 162 and the metal plate 49, and is fixed so as to cover the inlet 162 in order that air in the water tank 104 may not pass through the inlet 162 without passing through the filter 160.

As shown in FIG. 5, the filter 160 is mounted on an inner bottom surface of the water tank 104. The filter 160 is generally shaped like an arc in left-right symmetry about a center line L3 of the drum-type washer-dryer apparatus X in plan view as seen looking from inside of the water tank 104, and left-side part thereof in the drawing faces the inlet 162. As shown in FIG. 4, the blower fan 135 is provided so as to face the inlet 162. In FIG. 5 is shown the dehumidifying heat exchanger 133 provided in middle of a channel of air flowing toward the inlet 162.

Air or laundry water having flowed in a direction perpendicular to a plane of FIG. 5 through the dehumidification channel 164 flows through the filter 160 into the blower 131. In the washing step or the rinsing step, laundry water flows in the water tank 104 and the blower 131 and foreign matter as thrum contained in the laundry water is thus trapped by passage of the laundry water through the filter 160, so that the foreign matter is prevented from intruding into the blower 131. The foreign matter trapped by the filter 160 is removed from a surface of the filter 160 by water flow produced by rotation of the rotation drum 105, and clogging of the filter 160 is accordingly eliminated. The inner circumferential surface of the water tank 104 is shaped like a gentle arc and along directions of rotation of the rotation drum 105, and foreign matter having sunk to bottom of the water tank 104 is therefore shaken in the directions of the rotation by the water flow produced by the rotation of the rotation drum 105; however, the filter 160 provided on the bottom face of the water tank 104 is resistant to readhesion of the foreign matter to the filter 160. In the drying step, air flows in the water tank 104 and the blower 131, and foreign matter contained in the air is thus trapped with passage of the air through the filter 160, so that the foreign matter is prevented from intruding into the blower 131.

In order to trap foreign matter in air or laundry water that is conveyed by the blower 131, the filter 160 has only to cover an area on which the suction force of the blower fan 135 acts, that is, lower left part of the water tank 104 in the drawing (part that faces the inlet 162), as shown in FIG. 5. Such foreign matter conveyed by the laundry water or air in the actual washing step, rinsing step or drying step, however, may be accumulated on the filter 160 in a long span and, sooner or later, accumulation of the foreign matter on an area on the filter 160 facing the inlet 162 may cause a decrease in suction efficiency.

In the embodiment, therefore, the filter 160 is used that faces not only the lower left part of the water tank 104 in FIG. 5 but also lower right part of the water tank 104 in FIG. 5. That is, the filter 160 is positioned over an area larger than an opening area of the inlet 162, as seen looking in the direction of the central axis L1 of the water tank 104. As a result, foreign matter can be trapped by right part of the filter 160 in FIG. 5 if foreign matter has been accumulated on left part of the filter 160 in FIG. 5, and thus a filtering effect can be maintained for an extremely long term.

The filter 160 is not shaped like a simple flat plate but includes a swelling part 161 that swells in a direction to the water tank 104 (direction to the metal plate 49), as shown in FIG. 6 and FIG. 7. The swelling part 161 defines an air channel between the bottom surface of the water tank 104 and the filter 160 and thereby ensures long-term availability of the filter 160.

Though the filter 160 may be a plastic molding or a metal plate from which small discs have been punched out instead of using metallic yarn woven like reticularly, such a molding and a punched article, in practice, may have burrs and return scrap around bores produced by the punching of the small discs and may suffer from clogging of the small bores because of thrum, flue or the like that may be hooked on the burrs and scrap. Therefore, the filter 160 is desirably composed of a net structure having wires woven reticularly. Such a net structure is not only free from above-mentioned worry of burrs and return scrap but allows an increase in ratio of small-bore area to plate surface area (i.e., aperture ratio), resulting in excellent capability as foreign matter trapping means.

As the wires constituting the filter 160, resin wires and the like are conceivable other than metal wires; however, metal wires are preferable because metal wires have smooth surfaces and resist catching thrum, flue and the like. To fix crossings of meshes of the wires, e.g., by resin coating of metallic yarn woven reticularly, prevents occurrence of problems such as variation in roughness of the meshes that may be caused by foreign matter caught between the crossed wires, shift of the crossings or the like.

The roughness of the meshes of the filter 160 may be between 1 mm and 3 mm. Setting the roughness of the meshes of the filter 160 between 1 mm and 3 mm prevents early clogging of the filter 160 that may be caused by comparatively small foreign matter such as flue.

By such provision of the filter 160, problems are avoided including twining of foreign matter such as thrum and flue around the blower fan 135 or the shaft 152 thereof. Additionally, as described above, a region where the filter 160 is positioned extends not only over part which faces the inlet 162 and on which the suction force of the blower fan 135 directly acts but also to part distant from the inlet 162, so that the suction force of the blower fan 135 can be kept strong for a long period. As a result, drying capability of the drum-type washer-dryer apparatus X can be kept at high level for a long period.

Figure 9:
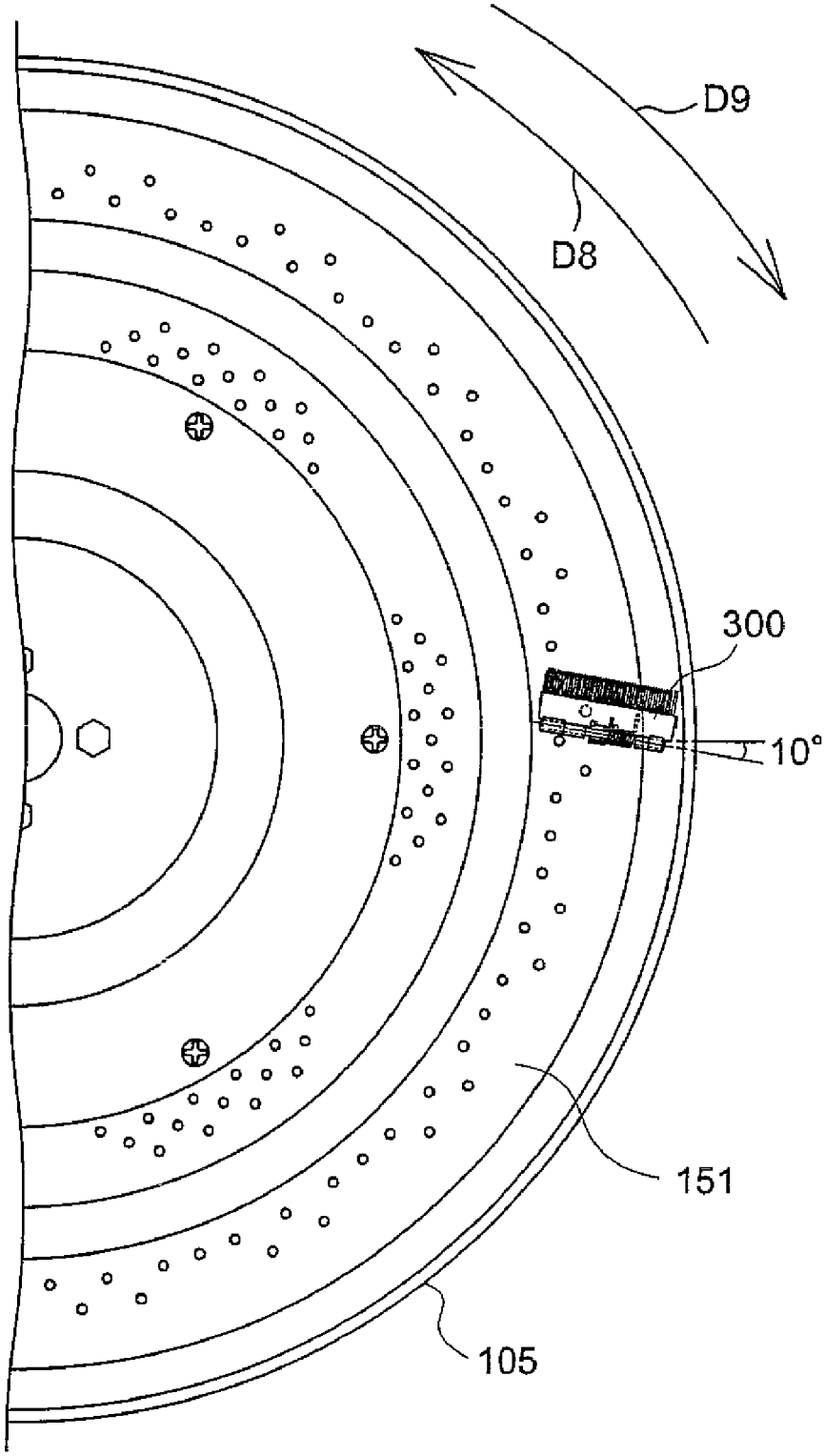
FIG. 9 is a schematic diagram showing an outer bottom surface of a rotation drum of the drum-type washer-dryer apparatus.

The clogging of the filter 160 in the embodiment is automatically eliminated by water flow produced by the rotation of the rotation drum 105 in the washing step or the rinsing step. As shown in FIG. 9, however, two cleaning devices 300 (only one is shown in FIG. 9) for cleaning the filter 160 with use of a mechanical force of the drum-type washer-dryer apparatus X are mounted on an outer bottom surface 151 (surface facing the water tank 104 on a side of the motor 109) of the rotation drum 105 in order to eliminate the clogging of the filter 160 more reliably. One of the cleaning devices 300 is positioned in 180 degrees rotational symmetry with respect to the other. The outer bottom surface 151 is an example of mount surface.

Figure 10A:
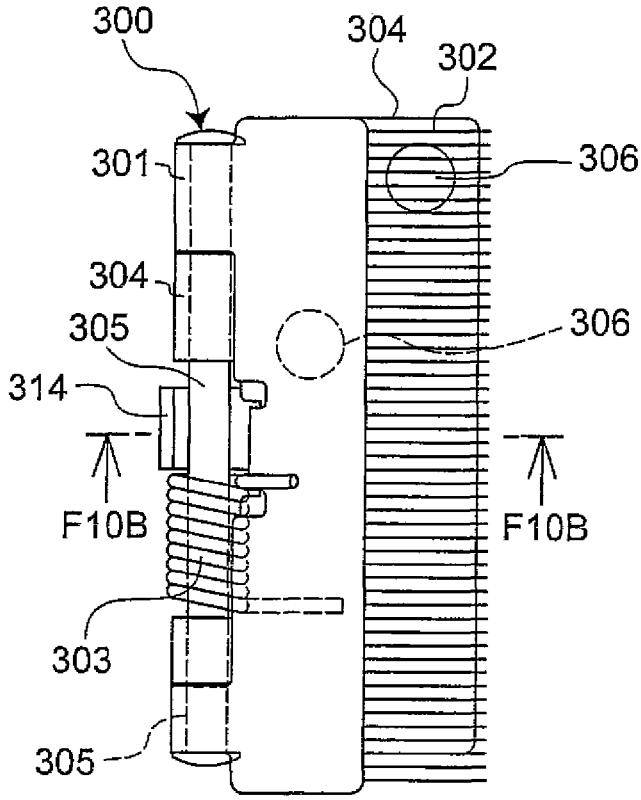
FIG. 10A is a schematic plan view of a cleaning device that is not in cleaning operation.
Figure 10B:
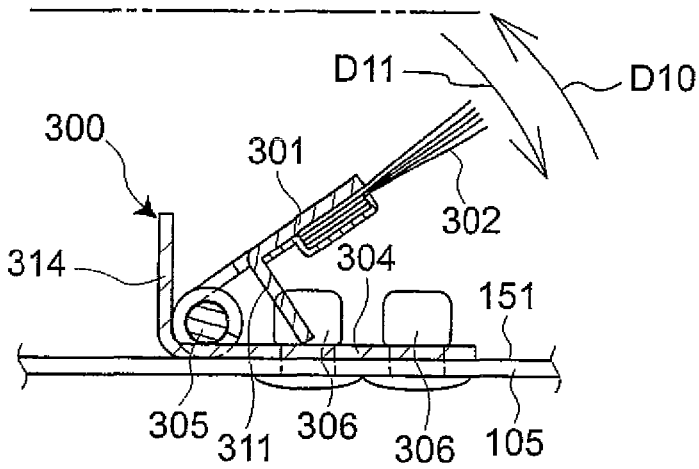
FIG. 10B is a schematic sectional view taken along line F10B-F10B in FIG. 10A.

FIG. 10A shows a schematic plan view of a cleaning device 300 that is not in operation of cleaning the filter 160. FIG. 10B shows a schematic section taken along line F10B-F10B in FIG. 10A. In FIG. 10B, a position of the filter 160 is shown by a two-dot chain line.

As shown in FIG. 10 and FIG. 10B, the cleaning device 300 has a main body 301 made of stainless steel and pivotable about one end thereof relative to the outer bottom surface 151 of the rotation drum 105, a brush 302 made of polyester or nylon and fixed to the other end of the main body 301, a bias spring 303 for biasing the main body 301 in a direction of an arrow D11, and a fixed part 304 made of stainless steel and fixed by fixation pins 306 onto the outer bottom surface 151 of the rotation drum 105. The brush 302 is an example of the cleaning part, and the bias spring 303 is an example of the bias part.

The one end of the main body 301 is connected to one end of the fixed part 304 by a hinge pin 305, so that the main body 301 is pivotable relative to the fixed part 304. More specifically, cylindrical parts are provided in the one end of the main body 301 and in the one end of the fixation part 304, and the columnar hinge pin 305 is inserted in the cylindrical parts.

A central axis of the hinge pin 305 is slanted at 10 degrees relative to a radial direction of the rotation drum 105 (see FIG. 9). That is, a pivotal axis of the main body 301 is slanted at 10 degrees to the radial directions of the rotation drum 105.

Positions where the cleaning devices 300 are mounted are set such that the devices make respective tracks across the filter 160, that is, the devices cross the filter 160, when the rotation drum 105 rotates.

The cleaning devices 300 have a structure that restricts an angle which the main body 301 forms with the fixed part 304 (the angle will be referred to as "pivoting angle of the main body 301," hereinbelow). More specifically, a stopper 314 is provided in the fixed part 304 in order to prevent the pivoting angle of the main body 301 from exceeding 90°, which is an example of first angle, when the main body 301 pivots in a direction of an arrow D10 (opening direction). On the other hand, a stopper 311 is provided on the main body 301 in order to prevent the pivoting angle of the main body 301 from being less than 35°, which is an example of second angle, when the main body 301 pivots in a direction of an arrow D11 (closing direction). The stopper 311 is an example of second stopper, and the stopper 314 is an example of first stopper.

Figure 11A:
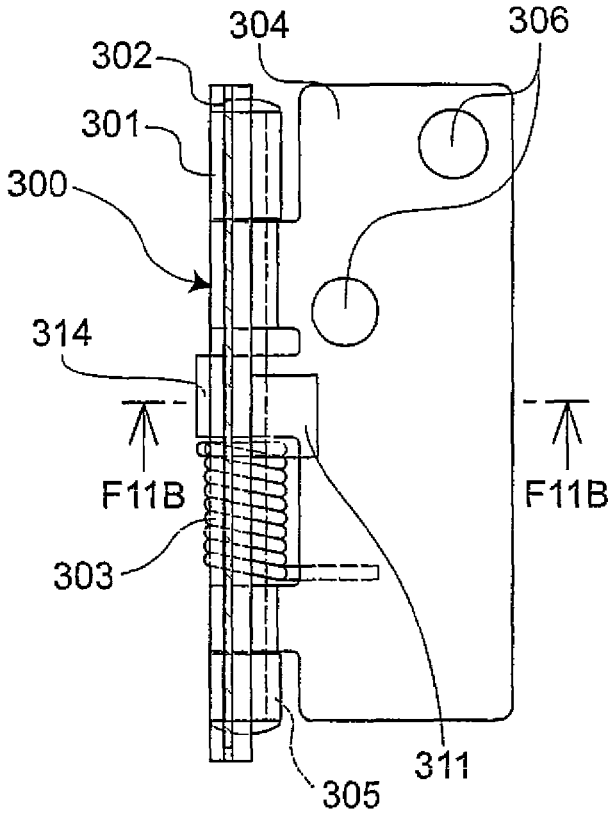
FIG. 11A is a schematic plan view of the cleaning device that is in cleaning operation.
Figure 11B:
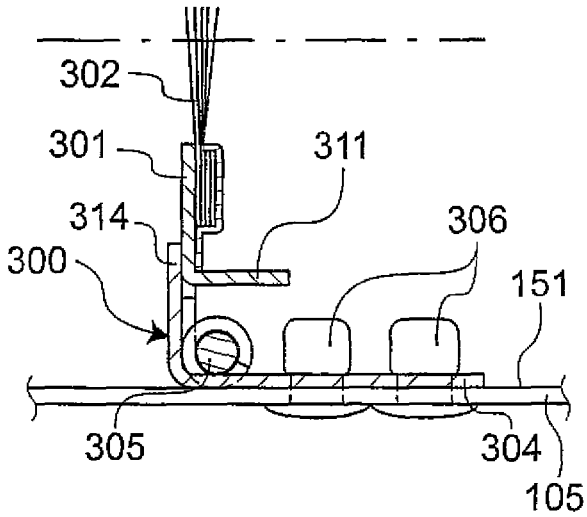
FIG. 11B is a schematic sectional view taken along line F11B-F11B in FIG. 11A.

FIG. 11A shows a schematic plan view of a cleaning device 300 that is in operation of cleaning the filter 160. FIG. 11B shows a schematic section taken along line F11B-F11B in FIG. 11A. In FIG. 11B, a position of the filter 160 is shown by a two-dot chain line.

The cleaning of the filter 160 is performed in a state in which the main body 301 has pivoted in the direction of the arrow D10 and has the pivoting angle of 90°, as shown in FIG. 11A and FIG. 11B. In the state in which the main body 301 has the pivoting angle of 90°, the brush 302 is in contact with the filter 160.

Hereinbelow, the cleaning of the filter 160 that is performed by the cleaning devices 300 will be detailed further.

Before the filter 160 is cleaned by the cleaning devices 300, water is fed into the water tank 104 so that the whole filter 160 is soaked in the water. Subsequently, the rotation drum 105 is rotated at 80 rpm in a direction of an arrow D8 in FIG. 9. Consequently, each of the main bodies 301 moving in the water is subjected to a dynamic pressure of the water. Thus the main body 301 pivots in the direction of the arrow D10 in FIG. 10B against a biasing force of the bias spring 303 and the pivoting angle of the main body 301 reaches 90°. That is, the main body 301 reaches such a state as shown in FIG. 11A and FIG. 11B.

By the resultant contact of the brush 302 with the filter 160, foreign matter is separated from the filter 160 and clogging of the filter 160 is eliminated.

Thus a burden on user with regard to maintenance of the filter 160 can be reduced.

An effect with which the brush 302 separates foreign matter from the filter 160 is particularly the greater in positions that are the nearer to the track of the passage of the cleaning devices 300, and thus the filter 160 of the embodiment may have a concave shape in an area E near to the center of the rotation drum 105 as shown in FIG. 5. A distance between the cleaning device 300 and the rotation axis of the rotation drum 105 can be configured so as to differ from that between the other cleaning device 300 and the rotation axis of the rotation drum 105, therefore, the filter 160 can be wider and the cleaning effect can be imparted to such recessed area E.

When the main body 301 is subjected to the dynamic pressure of the water, the stopper 314 in the fixed part 304 prevents the pivoting angle of the main body 301 from exceeding 90°.

This prevents loss of the contact between the brush 302 and the filter 160 due to excessive opening of the main body 301.

When the main body 301 is not subjected to the dynamic pressure of the water, the stopper 311 on the main body 301 prevents the pivoting angle of the main body 301 from being less than 35°.

Accordingly, a gap is defined between the main body 301 and the outer bottom surface 151 of the rotation drum 105, so that the main body 301 can be pivoted in the direction of the arrow D10 in FIG. 10B without excessive increase in the rotation speed of the rotation drum 105.

The pivotal axes of the main bodies 301 are slanted at 10 degrees to the radial directions of the rotation drum 105, so that wind noise caused by the cleaning devices 300 can be reduced.

Figure 12:
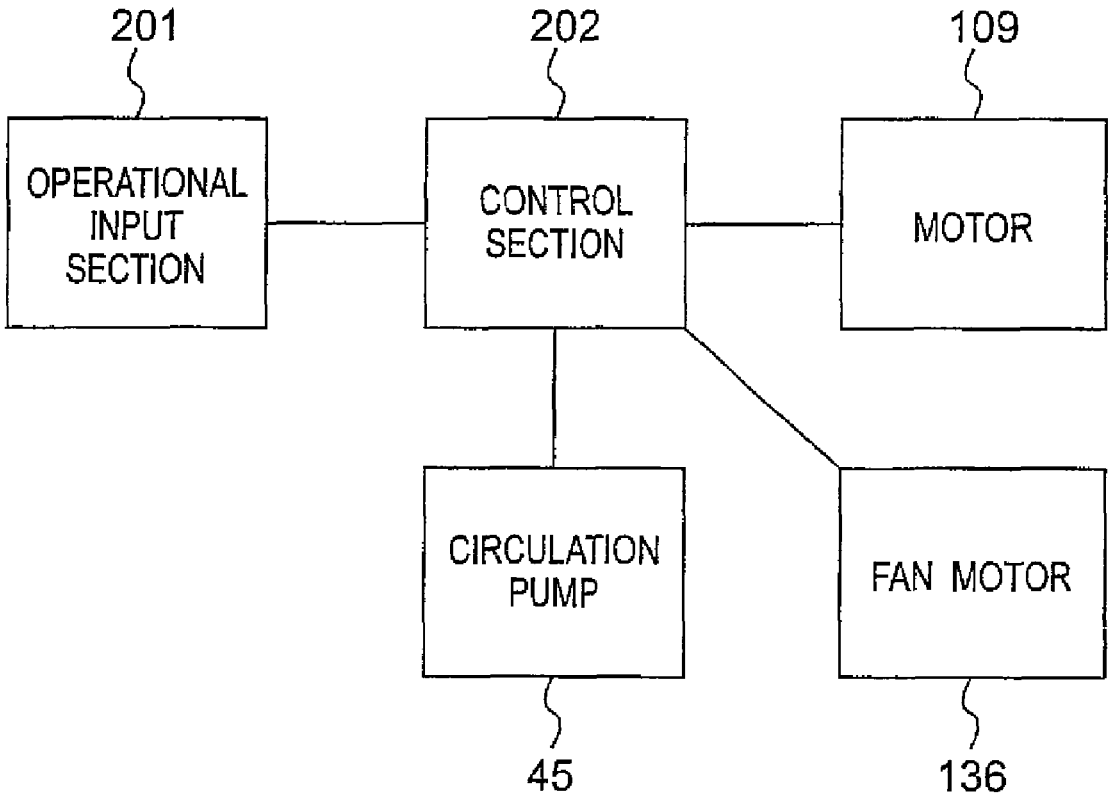
FIG. 12 is a block diagram showing main components of the drum-type washer-dryer apparatus.

FIG. 12 shows a block diagram with regard to main components of the drum-type washer-dryer apparatus X.

The control section 202 has computing units such as CPU and storage units such as ROM and RAM, and generally controls the drum-type washer-dryer apparatus X. An operational input section 201 in FIG. 12 is an interface for operational input that is provided in the operation panel 211 of the drum-type washer-dryer apparatus X. Operational input information from the operational input section 201 is inputted into the control section 202. Through operational input into the operational input section 201, a user selects an operation course from washing courses such as "standard," "soaking," "large wash," "Ag rinsing," "my-home style," and "dry" courses and maintenance courses such as "tank cleaning" course for washing and cleaning the water tank 104, the rotation drum 105 and the like and "filter cleaning" course that is designed specifically for removal of foreign matter from the filter 160 and, based on the selected course, the control section 202 controls components of the drum-type washer-dryer apparatus X including the motor 109, the circulation pump 45, and the fan motor 136.

Figure 13:
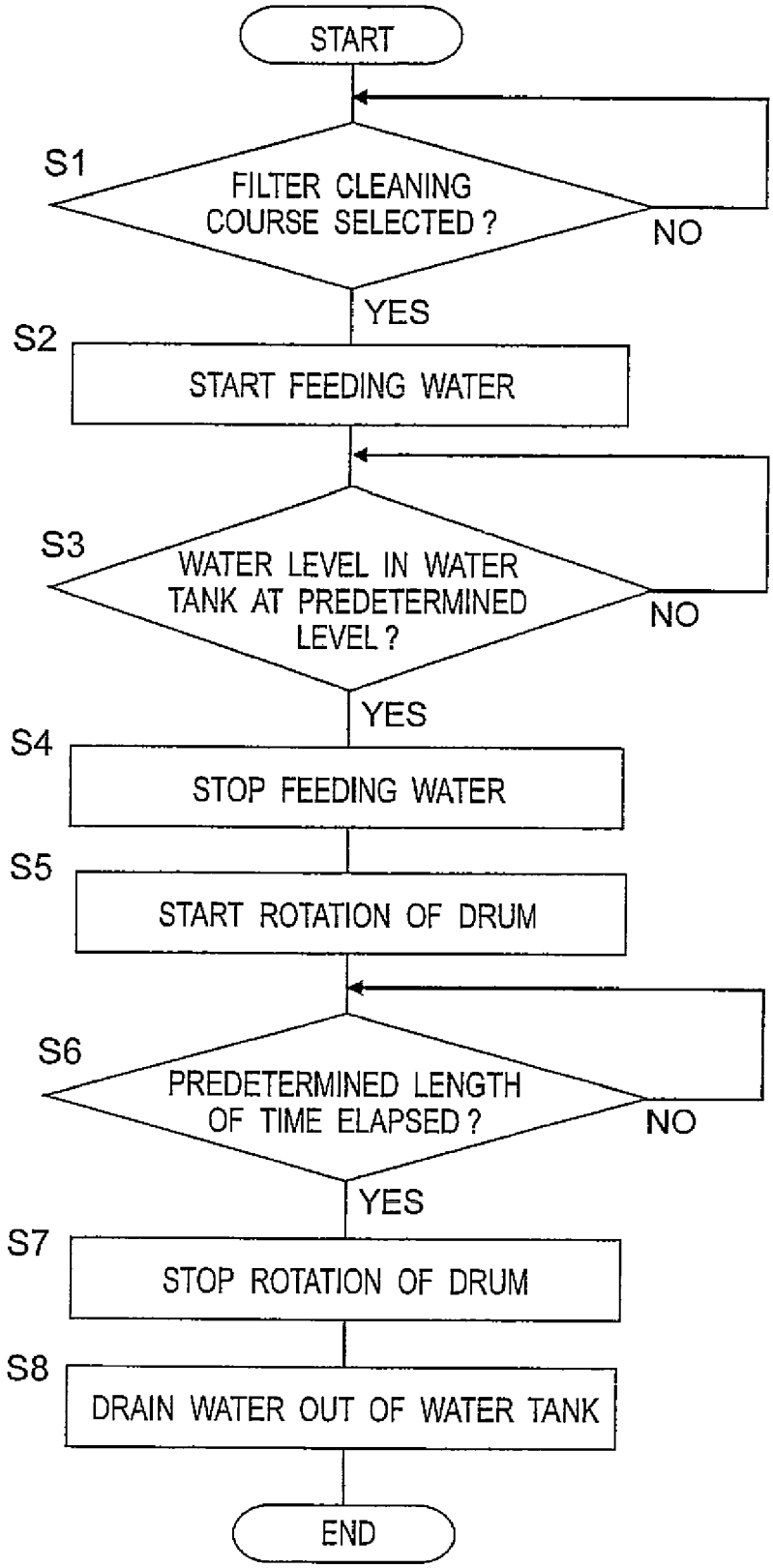
FIG. 13 is a flow chart of a method for controlling the drum-type washer-dryer apparatus.
Figure 14:
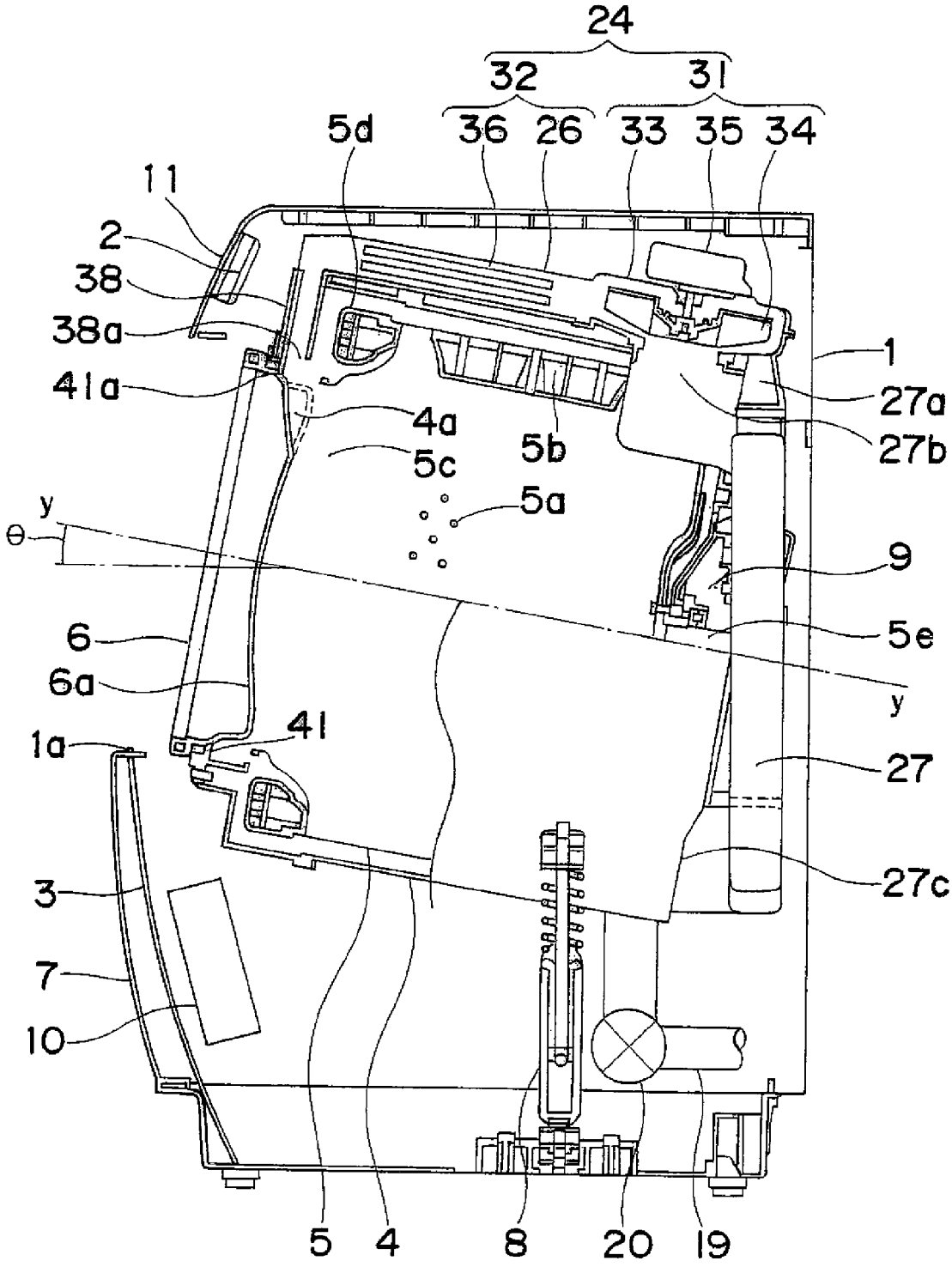
FIG. 14 is a schematic section of a conventional drum-type washer-dryer apparatus with an outside door opened.
Figure 15:
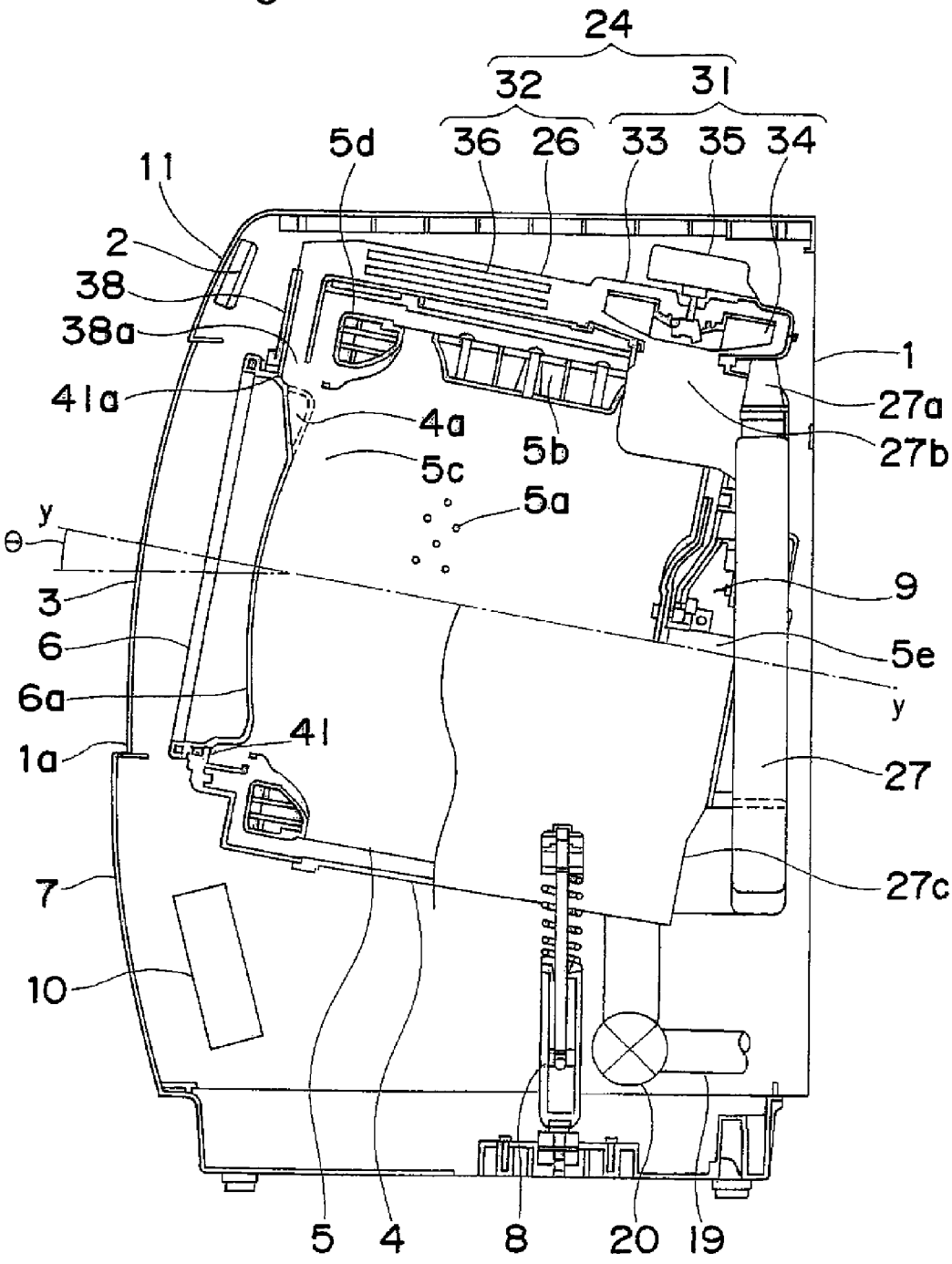
FIG. 15 is a schematic section of the conventional drum-type washer-dryer apparatus with the outside door closed.

FIG. 13 shows a flow chart representing a processing procedure of the control section 202.

Hereinbelow, contents of process control performed by the control section 202 will be described with use of FIG. 13.

In a step S1 in the processing procedure of the control section 202, it is initially determined whether the "filter cleaning" course is selected or not by an operation by a user on the operation panel 211. If it is determined that the "filter cleaning" course is selected, the processing goes to next step S2. If it is determined that the "filter cleaning" course is not selected, on the other hand, the determination in the step S1 is carried out again.

Subsequently, feeding water into the water tank 104 is started in the step S2, and it is determined in the step S3 with use of a water level sensor (not shown) whether water level in the water tank 104 has reached a predetermined level or not.

If it is determined that the water level in the water tank 104 has reached the predetermined level, the processing goes to next step S4. If it is determined that the water level in the water tank 104 has not reached the predetermined level, on the other hand, the determination in the step S3 is carried out again. The predetermined water level is set higher than water level in the water tank 104 on occasion of the washing step in the washing courses. That is, a larger quantity of water is fed into the water tank 104 when the filter is cleaned than in the washing step in the washing courses.

Subsequently, feeding water into the water tank 104 is halted in a step S4, and the rotation drum 105 is rotated, in a step S5, in the direction of the arrow D8 in FIG. 9. Then the control section 202 controls the rotation speed of the rotation drum 105 so as to set the speed at 80 rpm.

Subsequently, it is determined in a step S6 whether a predetermined length of time has elapsed or not since the start of the rotation of the rotation drum 105. If it is determined that the predetermined length of time has elapsed, the processing goes to next step S7. If it is determined that the predetermined length of time has not elapsed, on the other hand, the determination in the step S6 is carried out again.

Finally, the rotation of the rotation drum 105 is halted in the step S7, and the water in the water tank 104 is thereafter drained out in a step S8.

In the embodiment, the steps S2 through S4 constitute an example of water feeding step and the steps S5 through S7 constitute an example of rotating step.

The rotation drum 105 is thus rotated, in the filter cleaning course, in the direction of the arrow D8 in FIG. 9, which direction is opposite to a direction in which the rotation drum 105 rotates in the dewatering step (direction of an arrow D9 in FIG. 9).

In the dewatering step, therefore, the main body 301 is restrained from opening and the pivoting angle of the main body 301 does not reach 90°.

As a result, unnecessary contact of the brush 302 with the filter 160 is reduced, so that a life span of the brush 302 can be prolonged.

In the washing step in each of the washing courses, the rotation drum 105 is rotated alternately in the direction of the arrow D8 and in the direction of the arrow D9; however, the biasing force of the bias spring 303 then exceeds the dynamic pressure of the water because the rotation speed of the rotation drum 105 in the washing courses is set at 50 rpm lower than the rotation speed in the filter cleaning course.

In the washing step in each of the washing courses also, therefore, the main body 301 is restrained from opening and the pivoting angle of the main body 301 does not reach 90°.

As a result, the unnecessary contact of the brush 302 with the filter 160 is further reduced, so that the life span of the brush 302 can further be prolonged.

Though the main body 301 and the fixed part 304 that are made of stainless steel are used in the above embodiment, there may be substituted a main body and a fixed part that are made of other metal or resin.

Though the main body 301 is mounted through the fixed part 304 onto the outer bottom surface of the rotation drum 105 in the above embodiment, the main body 301 may pivotably and directly be mounted onto the outer bottom surface of the rotation drum 105 without the fixed part 304.

In the above embodiment, the pivotal axis of the main body 301 is slanted at 10 degrees to the radial directions; however, the pivotal axis of the main body 301 may be slanted at an angle other than 10 degrees to the radial directions.

Though the filter cleaning course is designed specifically for removal of foreign matter from the filter 160 in the above embodiment, the filter cleaning course may double as the tank cleaning course for cleaning the water tank 104, the rotation drum 105 and the like.

In the above embodiment, the spring force of the bias spring 303 is set so that, when the rotation drum 105 is rotated at 80 rpm in the direction of the arrow D8 in FIG. 9, the main body 301 pivots in the direction of the arrow D10 in FIG. 10B and thus has the pivoting angle of 90°; however, the spring force of the bias spring 303 may be set so that, when the rotation drum 105 is rotated at a rotation speed other than 80 rpm in the direction of the arrow D8 in FIG. 9, the main body 301 pivots in the direction of the arrow D10 in FIG. 10B and thus has the pivoting angle of 90°. Preferably, the rotation speed other than 80 rpm is higher than the rotation speed on occasion of the washing step in the washing courses.

As far as the bias spring 303 biases the main body 301 in the direction of the arrow D11 in FIG. 10B, the bias spring 303 may impart a tensile force to the main body 301 or may impart a compressive force to the main body 301.

For cleaning the filter, the rotation at a constant speed in the direction of the arrow D8 in FIG. 9 and the rotation at the constant speed in the direction of the arrow D9 in FIG. 9 may be performed alternately. The constant speed has to be a speed at which the main body 301 pivots by a dynamic pressure of water so that the brush 302 comes into contact with the filter 160.

Providing that an orientation in which the cleaning devices 300 are mounted is opposed to that in the above embodiment, the filter can be cleaned with the rotation drum 105 rotated at a constant speed in the direction of the arrow D8 in FIG. 9. The constant speed, however, has to be a speed at which the main body 301 pivots by a dynamic pressure of water so that the brush 302 comes into contact with the filter 160.

The water that is fed into the water tank 104 for cleaning the filter may contain detergent or may be water not containing detergent.

Though two cleaning devices 300 are provided in the embodiment, the number of the cleaning devices may be one or not smaller than three and the cleaning devices may be mounted at different distances from the center of the rotation drum 105 in the radial directions. That is, the number of the cleaning devices 300 may appropriately be determined. Providing that a plurality of cleaning devices 300 are provided, it is desired that a center of gravity of the plurality of cleaning devices 300 as a whole is on the rotation axis of the rotation drum 105, because occurrence of vibration is thereby prevented when the rotation drum 105 is rotated at high speed in the dewatering step and the like.

In the above embodiment, the whole filter 160 is soaked in water fed into the water tank 104. Even if a portion or the whole of the filter 160 is not soaked in water fed into the water tank 104, however, the filter 160 can be cleaned by the brush 302 that is brought into contact with the filter 160 through action, on at least part of the main body 301, of the dynamic pressure of the water in the water tank 104 produced by the rotation of the rotation drum 105.

In all time zones of the washing step of the washing courses in the above embodiment, the rotation drum 105 is rotated at rotation speeds that do not cause the pivot of the main body 301 due to the dynamic pressure of water and the contact of the brush 302 with the filter 160. The rotation drum 105, however, may be rotated, in some time zones of the step, at rotation speeds that cause the pivot of the main body 301 due to the dynamic pressure of water and the contact of the brush 302 with the filter 160. In this case, foreign matter can automatically be removed from the filter 160 in the washing step in the washing courses even if a user has not selected the filter cleaning course. The above-mentioned some time zones are preferably in latter half of the washing step and prior to the drainage.

In all time zones of the rinsing step of the washing courses in the above embodiment, the rotation drum 105 is rotated at rotation speeds that do not cause the pivot of the main body 301 due to the dynamic pressure of water and the contact of the brush 302 with the filter 160. The rotation drum 105, however, may be rotated, in some time zones of the step, at rotation speeds that cause the pivot of the main body 301 due to the dynamic pressure of water and the contact of the brush 302 with the filter 160. In this case, foreign matter can automatically be removed from the filter 160 in the rinsing step in the washing courses even if a user has not selected the filter cleaning course. The above-mentioned some time zones are preferably in latter half of the rinsing step and prior to the drainage.

Though the inlet 162 of the blower 131 faces the outer bottom surface 151 of the rotation drum 105 in the above embodiment, the inlet 162 of the blower 131 may face the outer circumferential surface of the rotation drum 105. In this configuration, the cleaning devices 300 should be mounted on the outer circumferential surface of the rotation drum 105.

In the above embodiment, whether clogging of the filter 160 has occurred or not may be detected just before the termination of the drying step. If occurrence of the clogging of the filter 160 is detected, a user may be informed of the occurrence of the clogging. Whether the clogging of the filter 160 has occurred or not can be detected on basis of air temperatures detected by the thermistor 141 and 142.

It is needless to say that the invention can be applied not only to drum-type washer-dryer apparatus but also to, for example, fully automatic washer apparatus.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A washer-dryer apparatus comprising:

an outer casing (101);

a water tank (104) provided in the outer casing;

a water feeding channel for feeding water into the water tank (104);

a washing and dewatering tub (105) that is rotatably placed in the water tank (104) and that accommodates a wash;

a blower (131) that has an inlet (162) for sucking air from the water tank (104) and that blows into the washing and dewatering tub (105) the air sucked through the inlet (162);

a filter (160) that is positioned so as to face the washing and dewatering tub (105) and that covers the inlet (162);

a heater unit (132) for heating air that is sucked from the inlet (162) and that flows toward inside of the washing and dewatering tub (105); and a cleaning device (300) that is mounted on a mount surface (151) comprising a part of a water tank-side surface of the washing and dewatering tub (105) and that makes a track across the filter (160) when the washing and dewatering tub (105) rotates, the cleaning device (300), comprising:

a cleaning part (302);

a main body (301) that is provided with the cleaning part (302) and positioned such that at least part thereof is soaked in water supplied into the water tank (104), wherein the main body (301) brings the cleaning part (302) into contact with the filter (160) by pivoting in an opening direction relative to the mount surface (151) until a pivoting angle of the main body (301) becomes a first angle, while the main body (391) breaks the contact between the cleaning part (302) and the filter (160) by pivoting in a closing direction and bringing the cleaning part (302) closer to the mount surface (151); and a bias part (303) for biasing the main body toward the closing direction.

2. A washer-dryer apparatus as claimed in claim 1, wherein the cleaning device comprises a first stopper for preventing the pivoting angle of the main body from exceeding the first angle.

3. A washer-dryer apparatus as claimed in claim 1, wherein the cleaning device comprises a second stopper for preventing the pivoting angle of the main body from being less than a second angle that is less than the first angle.

4. A washer-dryer apparatus as claimed in claim 1, wherein the washing and dewatering tub has a cylindrical shape and the mount surface is a bottom surface on the water tank side of the washing and dewatering tub.

5. A washer-dryer apparatus as claimed in claim 4, wherein a pivot of the main body of the cleaning device is slanted relative to a radial direction of the washing and dewatering tub.

6. A washer-dryer apparatus controlling method for controlling the washer-dryer apparatus as claimed in claim 1, the method comprising:

a water feeding step of feeding water into the water tank such that a part of the filter where the track of the cleaning device crosses the filter is soaked in the water, and a rotating step of rotating the washing and dewatering tub, after the water feeding step, at a rotation speed at which the pivoting angle of the main body becomes the first angle.

7. A washer-dryer apparatus controlling method as claimed in claim 6, wherein a direction in which the washing and dewatering tub is rotated in the rotating step is opposed to a direction in which the washing and dewatering tub is rotated in a dewatering step.

* * * * *